US009145767B2

(12) United States Patent
Borges et al.

(10) Patent No.: US 9,145,767 B2
(45) Date of Patent: Sep. 29, 2015

(54) RECEIVING LATERAL WELLBORE AND METHOD FOR IMPLANTING SAME

(75) Inventors: Carlos Alberto Teles Borges, Macae (BR); Elias Saad Saade, Macae (BR); Mateus Albernaz Lemos, Campos (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 547 days.

(21) Appl. No.: 13/345,377

(22) Filed: Jan. 6, 2012

(65) Prior Publication Data

US 2012/0205159 A1 Aug. 16, 2012

Related U.S. Application Data

(63) Continuation-in-part of application No. PCT/BR2009/000387, filed on Nov. 27, 2009.

(30) Foreign Application Priority Data

Jul. 6, 2009 (BR) ..... 0902366

(51) Int. Cl.
*E21B 43/30* (2006.01)

(52) U.S. Cl.
CPC ..... *E21B 43/305* (2013.01)

(58) Field of Classification Search
CPC ..... E21B 7/04; E21B 43/305
USPC ..... 175/61, 62; 166/50, 52, 245
See application file for complete search history.

(56) References Cited

U.S. PATENT DOCUMENTS

| | | | | |
|---|---|---|---|---|
| 4,458,767 | A | 7/1984 | Hoehn, Jr. | |
| 5,016,710 | A * | 5/1991 | Renard et al. | 166/245 |
| 5,655,605 | A * | 8/1997 | Matthews | 166/370 |
| 6,729,394 | B1 | 5/2004 | Hassan et al. | |
| 7,475,741 | B2 * | 1/2009 | Waters | 175/45 |
| 8,272,447 | B2 * | 9/2012 | Lee et al. | 166/380 |
| 2006/0278396 | A1 * | 12/2006 | Sotomayor et al. | 166/313 |

FOREIGN PATENT DOCUMENTS

| | | | |
|---|---|---|---|
| WO | WO 99/60248 | A1 | 11/1999 |
| WO | WO 01/16457 | A1 | 3/2001 |
| WO | WO 2006/053434 | A1 | 5/2006 |

* cited by examiner

*Primary Examiner* — Robert E Fuller
(74) *Attorney, Agent, or Firm* — Sughrue Mion, PLLC

(57) ABSTRACT

A wellbore system and method for making viable the exploitation of oil deposits considered unviable, utilizing equipment available at the wells, wherein two wells, drilled in neighboring deposits, are connected by mechanical and hydraulic interconnection. The two wells include a first well (target well) in active production, fully equipped, and processing its production in a stationary production unit (SPU), and a second well, which is considered unviable. The second well initially appears as a pilot hole, can be used to map the reservoir of the deposit where it is located, and after the mapping procedure, its base can be cemented and abandoned. The pilot hole becomes the point of origin for drilling a horizontal lateral well in the direction of the first well, which becomes the target of the drilling and a recipient of production arising from the neighboring deposit where the second well is located.

10 Claims, 6 Drawing Sheets

RECEIVING LATERAL WELLBORE AND METHOD FOR IMPLANTING SAME

FIELD OF THE INVENTION

This invention relates to a new solution for making viable the exploitation of oil deposits considered unviable at present and a method for implementing it. More specifically, it relates to a constructive configuration proposed for oil wells, for exploiting oil deposits considered unviable at present and is based on taking advantage of installations close to wells (of dry or wet completion) or deposits, whether exploited or not, by means of mechanical and hydraulic connection.

DESCRIPTION OF THE RELATED TECHNOLOGY

The conception of the oil industry for offshore oil production, adopted at present, uses the following principle: a plurality of production wells are drilled in an oil production field. Strategically in the centre of this area, a floating or fixed platform—depending on the sheet of water—is positioned. Christmas trees are fitted to the various different oil wells, it being possible for production lines to be launched, these directing the oil produced in each well to a Stationary Production Unit (SPU), which will carry out the processing of the oil produced or which will be the centralising unit for all of the production.

Any new oil well to be drilled in the region must conform to some minimum parameters as, in order for the project to be viable, the cost of implementing the various equipment necessary for exploiting the deposit must be advantageous in the economic scenario of the time.

As a principal parameter, for the economic evaluation of the project, the estimate of the deposit volume stands out. Production during the useful life of the well must cover the cost of the equipment, i.e.: the Christmas tree fitted to the wellhead, the launching of a new production line and the respective pumping system. These are only some of the parameters evaluated in the economic analysis of the well.

In the case of offshore wells, other—also important—parameters are involved such as, for example, the location of the well, which must be within the perimeter of a SPU, for which the installation of a new production line is technically viable. Also due to economic matters, the depth of the sheet of water is a factor considered predominant in determining the type of completion to be used.

The completion of a well is a procedure which involves a set of operations following the drilling and is intended to equip it with all the devices necessary for making it capable of producing. The procedure is applicable both to vertical wells and to horizontal wells, which may or may not contain sand, always finishing with the fitting of a Christmas tree which is suitable for it.

In the event that the sheet of water is shallow or the SPU (Stationary Production Unit) allows, completion can be carried out with dry Christmas trees. This is equivalent to providing the wellhead on the surface, with it being possible for all the equipment to be handled by operators directly, a fact which represents a drastic reduction in costs of fitting, operation and subsequent maintenance.

When Christmas trees are fitted to wellheads provided on the seabed itself, the method is known as wet completion and therefore the devices can be handled only by divers or—depending on the depth of the ocean where the wellhead is installed—can be handled only by robots.

In this way, the cost of the extracted product is going to be directly related to the completion technique adopted in each case and to all the fittings which have to be provided and installed in a well to provide the production from the deposit, such as: wet Christmas trees (WCT) or dry Christmas trees (DCT), collection and transport lines, risers—rigid or flexible, electrical and hydraulic umbilicals, electrical cables, availability of a stationary production unit and various other equipment.

It is easy to understand that a well project is extremely sensitive to the type of completion chosen for the implantation of the production, this procedure being a determining factor for its economic viability.

In view of this, it is understood that, the greater the depth at which work is done, the greater the costs will be, often reaching such high values that many wells have their economical lives reduced and others, due to the characteristics of the oil or to the size of their reserves (VOIP—Volume of Oil In Place), do not economically justify even the investment in the infrastructure necessary for exploiting them. They are considered totally unviable and are therefore abandoned.

The value of a barrel of oil is a variable which, when high, makes greater investments in marginal deposits viable. However, in scenarios of low demand, it stimulates the search for alternative solutions which might make the exploitation of these deposits viable, with a reduction in costs and with maximum productivity.

In projects for wells with wet completion, various critical resources are used, floating drill rigs being the main one of these, possibly representing up to 60% of the total amount of the investment, which significantly burdens work for maintaining production. Their degree of criticality is directly related to demand.

Another factor which is being formed, resulting from the present economic scenario, relates to the demand for exploration and production equipment. Oil producers are increasingly concentrating efforts on research and projects for deposits located well below the seabed. So the supply of various submarine equipment has come to be considered critical, as there is a limited number of manufacturers for a growing demand, even when the value of a barrel of oil is low. An typical example of the oil industry is the wet completion equipment called a wet Christmas tree (WCT), for which delivery periods have recently varied between 24 and 36 months, depending on the specification.

This invention derives from this continual observation of the growing needs for adaptation of the present techniques, with the aim of making viable the utilisation of onshore or offshore fields considered mature or of marginal deposits considered unviable. More specifically, its application is intended for offshore fields, where there is the need for reducing the costs arising from work for maintaining production.

The implementation method uses already known drilling tools and techniques but their applicability becomes advantageous, as it ensures production from deposits or wells considered unviable using resources which are already available and in operation.

In search of this simplification and efficiency, the focus of the invention proposed is aimed at the utilisation of resources and techniques already made available and mastered but applied in such a way that they promote such a significant cost reduction that they can turn wells or deposits now considered unviable into satisfactorily profitable projects.

Another focus concerns a new concept of joint exploration, making other parallel applications possible.

In addition to raising the oil recovery factor in abandoned enterprises, the method now proposed can be used for making viable the commercial production of minor or marginal deposits, previously considered commercially unviable, according to the methods used so far by the oil industry. This means making the exploitation of oil wells and reserves, which are disregarded at present, economically viable.

One of the most common problems when a deposit of low VoIP is identified in offshore fields is the non-existence of inexpensive technology adapted to great depths or even shallow sheets of water but which manages to make viable preferentially the use of wells with dry completion as, with this technique, a drastic reduction in implementation costs is obtained.

Another problem is related to the wells of mature fields which, in a first analysis, lose economy or are affected by the risk of the value of a barrel of oil falling substantively in such a way as to alter the economic attractiveness of the investment already made. When one of these two problems occurs and attempts at finding an appropriate solution are unsuccessful, there is the possibility of a loss of economic value of the well and of all the equipment already installed.

To resolve these matters, there are various suggestions to the effect of interconnecting a profitable production well with another, unviable, neighbouring one and using the equipment which is in full activity for absorbing the production of an abandoned neighbouring well or of an economically unviable deposit. Nevertheless, none of these suggestions has managed to present a technically viable and inexpensive proposal.

For a better understanding of the advantages which the new well conception now presented and its implementation method offer, emphasis must be given to one of the greatest problems which is hindering the use of the equipment of a well in full activity for absorbing the production of an abandoned neighbouring well or of a deposit considered economically unviable.

Taking into account the technology available on the market now, when the conditions and possibilities of interconnecting an already equipped production well with another neighbouring well are analysed, a problem is encountered which has so far been without a technical solution and which is: to reach a remote target reservoir, from an existing well, using a modular drill rig.

On starting the procedure of drilling from an existing well, from the outset there is an initial limitation of diameter; gradually, diameter is lost and, at the end of a limit drilling length, it makes any type of completion impossible or even makes it impossible to continue drilling.

An objective of this invention is, therefore, to implement a new technology which makes it possible to economically exploit deposits of low value or of so-called mature fields.

As a result of the research carried out to this effect, a method has been invented whereby it is possible to use the means of production already existing in a profitable well and concurrently to drain the production of a deposit with the characteristics noted above: mature well, deposit of low VoIP in the vicinity, unprofitable or finally abandoned, without the need to commit a whole set of equipment normally necessary for production from a well.

The concern in the development of this new concept of a production well and the respective method is intended to simplify and cut the cost of the operation of completion, offering an effective and cheaper production option.

Other objectives which the receiving lateral well bore (RLWB) and its implementation method, objects of this invention, are intended to achieve are listed below:

a. To cut costs, both of installation and of maintenance.
b. To utilise the existing surface installations.
c. To reduce or eliminate the surface works.
d. To increase the possibility of productive utilisation of a well.
e. To reduce the drill rig time necessary for work for maintaining the production of a well (workovers).
f. To reduce operational cost.
g. To bring forward the entry of the project into operation.
h. To mitigate dependence on companies supplying equipment which is complex and with tardy delivery.

SUMMARY OF THE INVENTION

From a first point of view, the invention concerns a new well conception which comprises the interconnection of two separate wells, drilled respectively in neighbouring deposits—a first well (the target well) existing before the second well—and being in an initial situation of active production and fully equipped, processing its production in a Stationary Production Unit (SPU) which is also already installed. The second well (new) is in a remote neighbouring field at a distance of approximately 3 km or 4 km for example.

This second well initially appears as a pilot hole, by means of which it will be possible to map from the top to the base of the reservoir rock of the deposit where it is located. After the mapping procedure, its base is cemented and abandoned. The above-mentioned pilot hole becomes the point of origin of the procedures of drilling a long-reach horizontal lateral well in the direction of a pre-existing well, which becomes the target of the drilling and a future recipient of the production arising from the neighbouring deposit where the mapped well is located.

A lateral well is drilled with a wide diameter and preferentially passes through the reservoir which was the object of mapping, along its upper section, for its whole length.

Then, the pre-existing target well is provided with a deflecting channel, an opening subsequently being formed in its casing and—through this—a receiving lateral well bore is formed, which is given a casing. Downstream from the section of receiving lateral well bore, a small section of well without casing is provided. Interconnecting the two wells, a long section is drilled through the shale coming from the new well in the direction of the pre-existing well.

Following final completion, the wells are interconnected fluidically and producing but only the pre-existing well is equipped with a Christmas tree.

From a second point of view, the invention comprises a method for implementing this conception which, in short, follows these stages:

a—initially verifying the existence of a situation in which a fully equipped existing production well, which normally processes its production by means of a Stationary Production Unit (SPU), is close to another field which, in turn, has a deposit considered economically unviable, b—if there is no well already drilled in the area of interest, the drilling of a conventional pilot hole is started, c—mapping is carried out from the top to the base of the reservoir rock through the conventional pilot hole to confirm the applicability of the invention, d—after the mapping, the base of the conventional pilot hole is cemented and abandoned; the drilling of a long-reach horizontal lateral well bore in the direction of the existing production well starts, e—the lateral well bore is drilled in a wide diameter and passes through the reservoir of interest along its upper section, f—the preparatory procedures start in the target well, providing it with a deflecting channel and an opening being formed in its casing, g—from the opening, a start is made on the drilling of a receiving lateral well bore, which is duly cased, a small section of well bore being left without casing at its end, h—from the pilot hole, the drilling of a long section continues through the shale from the upper horizontal section already drilled up to interception with the non-cased section of the lateral well bore, i—the desired interception of the wells being obtained, the drilling stage comes to a close, j—the completion starts with connection between the two wells, with the use of a casing pipe which runs from the new production region to the end of the receiving lateral well bore, k—the casing is perforated in its productive section.

l—the selective fracturing of the producing rock (selective Frac Pack) is carried out in the region of the new deposit.

m—at the end of the completion, the pilot hole is provisionally abandoned, with cement or mechanical plugs and the drill rig which carried out the procedure is released.

BRIEF DESCRIPTION OF THE DRAWINGS

The invention will be described below in greater detail, in conjunction with the drawings which are listed below and which, for illustration only, accompany this specification, of which they are an integral part and in which.

DETAILED DESCRIPTION OF THE INVENTION

This invention relates to a new constructive configuration of a well for exploiting oil and method for implementing same. This proposal is intended to drastically reduce the cost in the exploitation of deposits which, in view of the present evaluation parameters, are considered of no commercial value, converting them to economically viable deposits.

For a better understanding of the advantages which this new conception and its production implementation method offer, it becomes necessary to clarify some details of the technology mastered at present by the oil industry.

There are some procedures in the oil industry, the technologies of which have already been developed to the point of forming part of a list of alternatives capable of being adopted with an excellent success and safety record.

Figure 1:
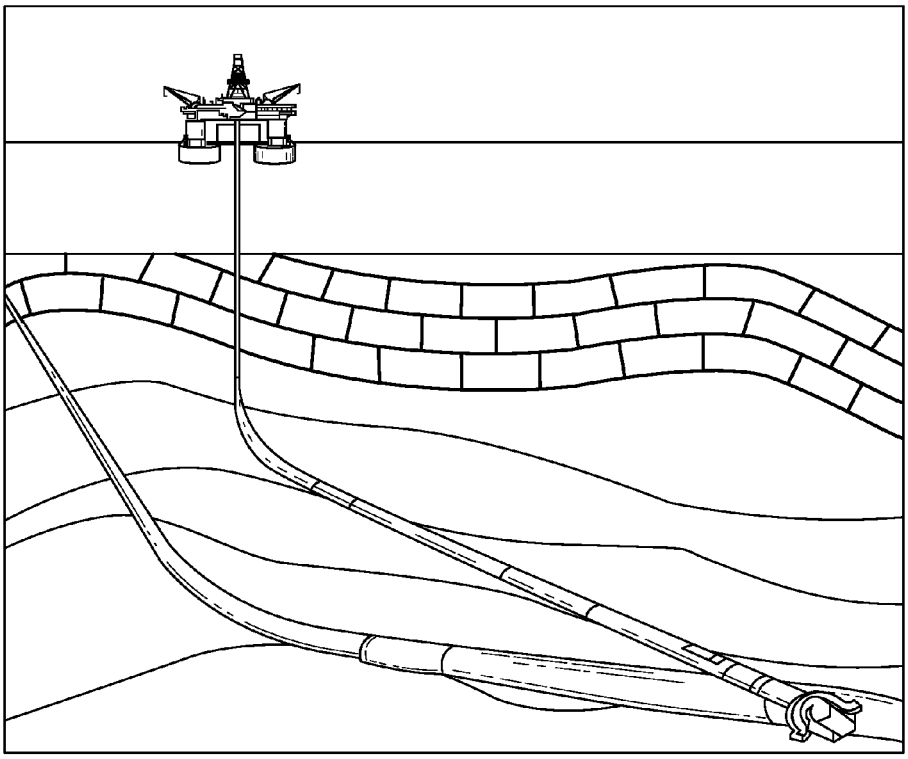
FIG. 1 depicts, in a schematic drawing, an interception between wells. (Prior Art)

One of these technologies is the interception of wells, widely adopted at present, with the objective of making possible the injection of water into the reservoir rock to overcome fire in blowout wells. This procedure can easily be understood by means of the schematic representation seen in FIG. 1.

Figure 2:
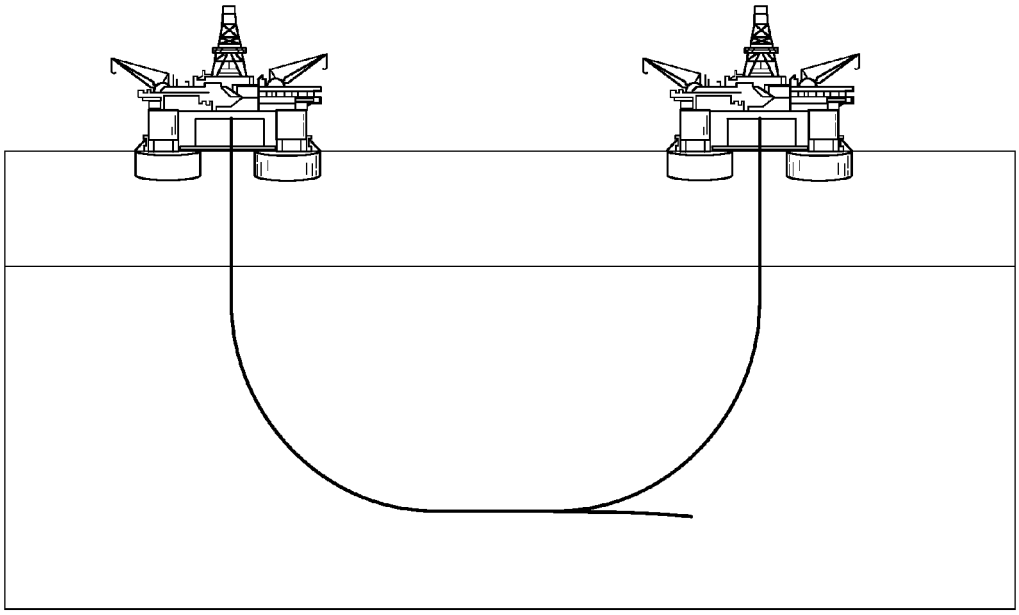
FIG. 2 schematically shows a "U" shaped well procedure. (Prior Art)

Another known concept of technology is called the "U" shaped well. In this case, two drill rigs simultaneously drill two wells which will collide frontally at their ends and at the end of the procedure both wells will be provided with all the equipment necessary for their respective completion, including their respective Christmas trees. This procedure can easily be understood by means of the schematic representation seen in FIG. 2.

Therefore, with the basis of these already known technologies, it is possible to understand the basic technological foundations which this invention uses to achieve its objects.

Figure 3:
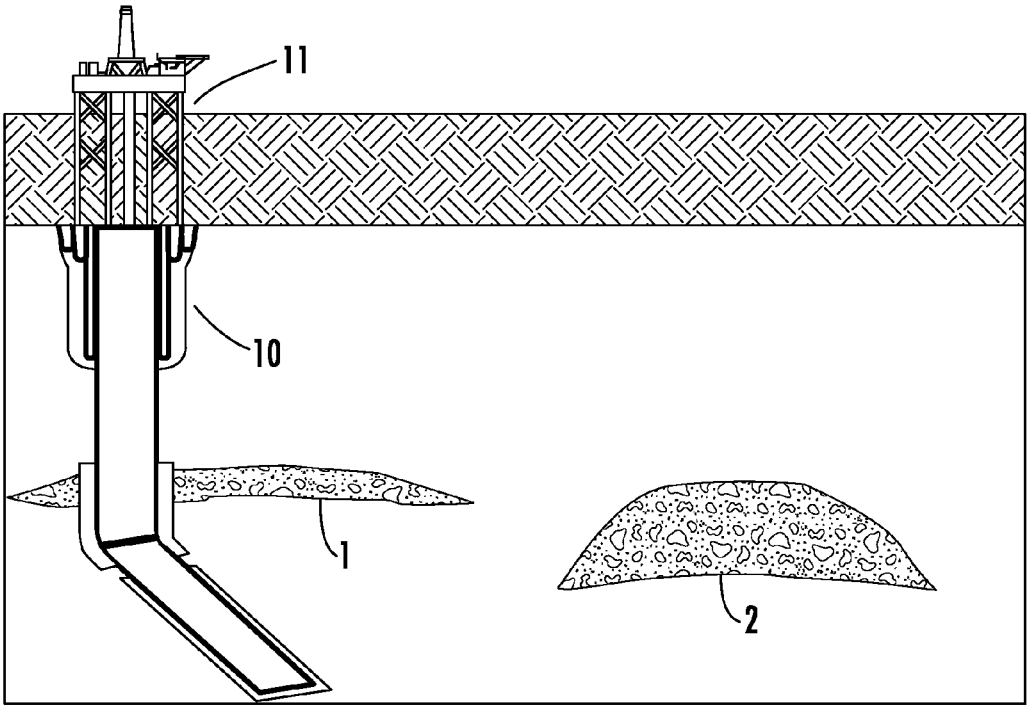
FIG. 3 shows, in schematic view, an initial scenario typically found in which the proposed invention can be applied.

From FIG. 3, there follows a sequence of illustrations which schematically show the object of this invention, the concept of the Receiving Lateral Well Bore (RLWB) and method for implementing same. The prime advantage of this invention immediately stands out due to its low end cost and due to presenting a new configuration of wells which are, however, drilled from technologies already known.

By means of FIG. 3, it is possible to visualise a scenario commonly encountered by the oil industry which, in the past, resulted in abandoned deposits or wells. The general sectional view of two neighbouring deposits (1) and (2) schematically shows an initial situation of a fully equipped existing well (10) which processes its production in a stationary production unit—SPU (11), also already installed. In the same illustration, the existence of a neighbouring field (2) at a distance of approximately 3 or 4 km, for example, can be verified.

For the purpose of understanding this invention, the reservoir of the deposit (2) has already been verified by drill rig, analysis having been carried out and the economic non-viability having been ascertained of its exploitation by means of installation of a wet Christmas tree—WCT—and the use of wet completion. In this way, exploiting the deposit/reservoir (2) with this concept would not be of low enough cost to justify its implementation. The installation of a SPU for dry completion would not be economically justified either.

Figure 4:
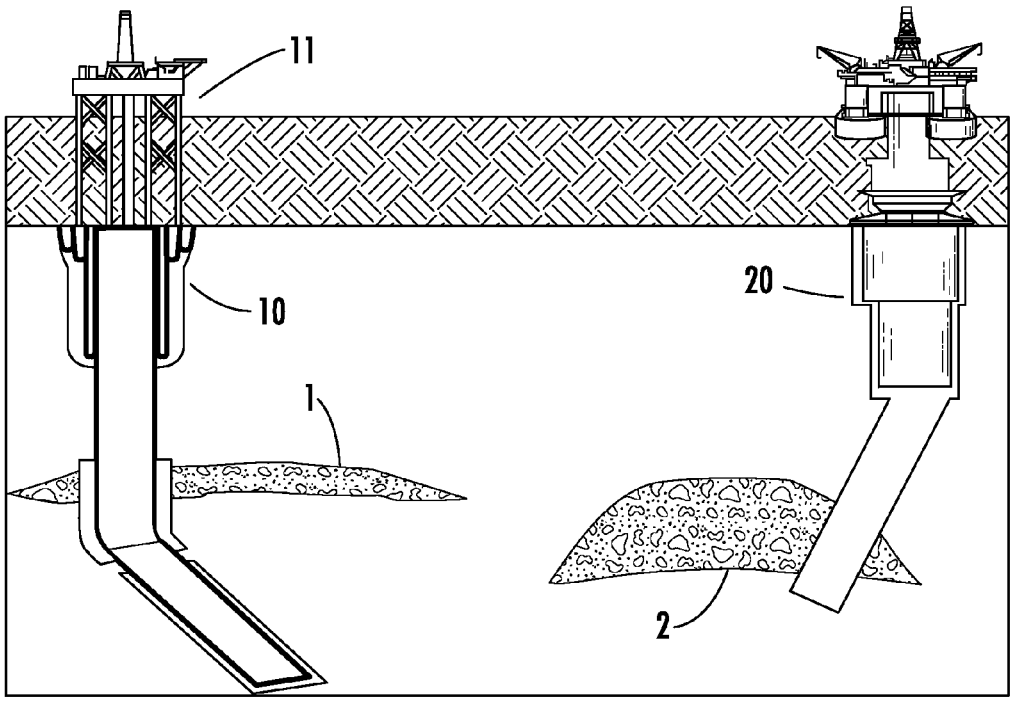
FIG. 4 shows, in schematic view, the first stage of implementation of the receiving lateral well bore—RLWB.

It must also be emphasised that FIG. 3 shows a neighbouring deposit (2) but it could also show, as in FIG. 4, a deactivated or low productivity mature well (20'), the commercial exploitation of which has ceased to be advantageous. Even so, the technology now proposed can also be applied, the due adaptations to each particular situation being observed.

FIG. 4 shows a situation in which, when no well has already been drilled, the drilling of a conventional pilot hole (20) is started in the very area of the deposit (2) of low commercial value.

The conventional pilot hole (20) has the function of making possible the mapping from the top to the base of the reservoir rock. This mapping will provide data to make it possible to monitor the drilling of a long horizontal well bore (not shown, however).

Figure 5:
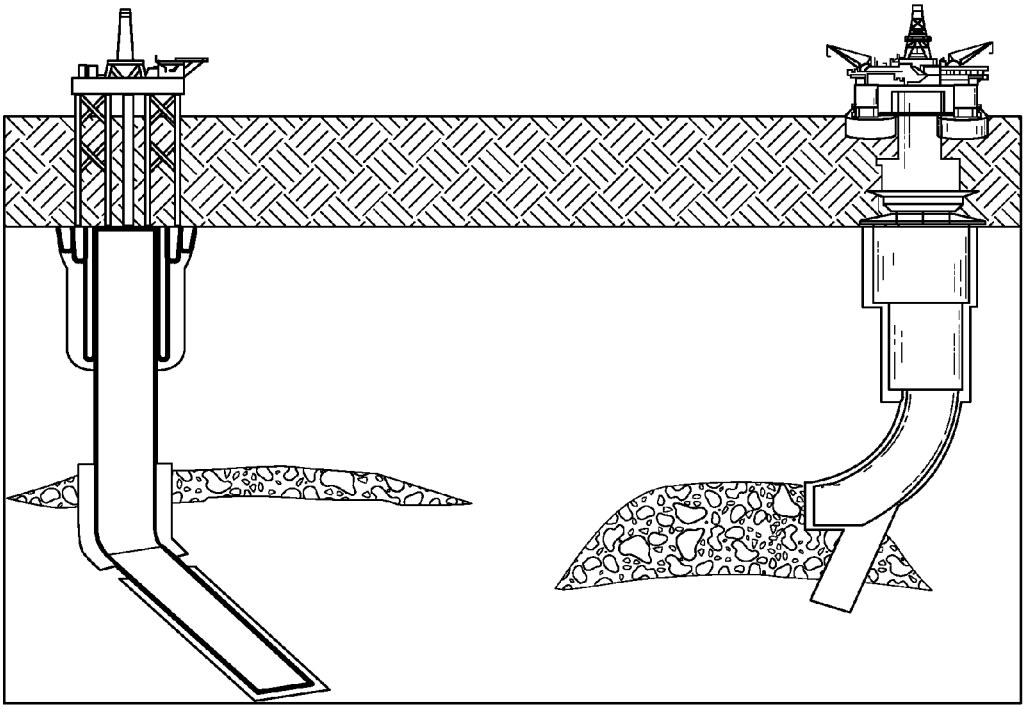
FIG. 5 shows, in schematic view, the stage of cementing the bottom of the well.

After this procedure, the base of the conventional pilot hole (20) is cemented (21) and abandoned, as displayed in FIG. 5.

It is easy to verify that, up to this point, customarily used technical resources have been used, these not signifying heavy, representative investments which might be reflected in the end cost of the production.

Figure 6:
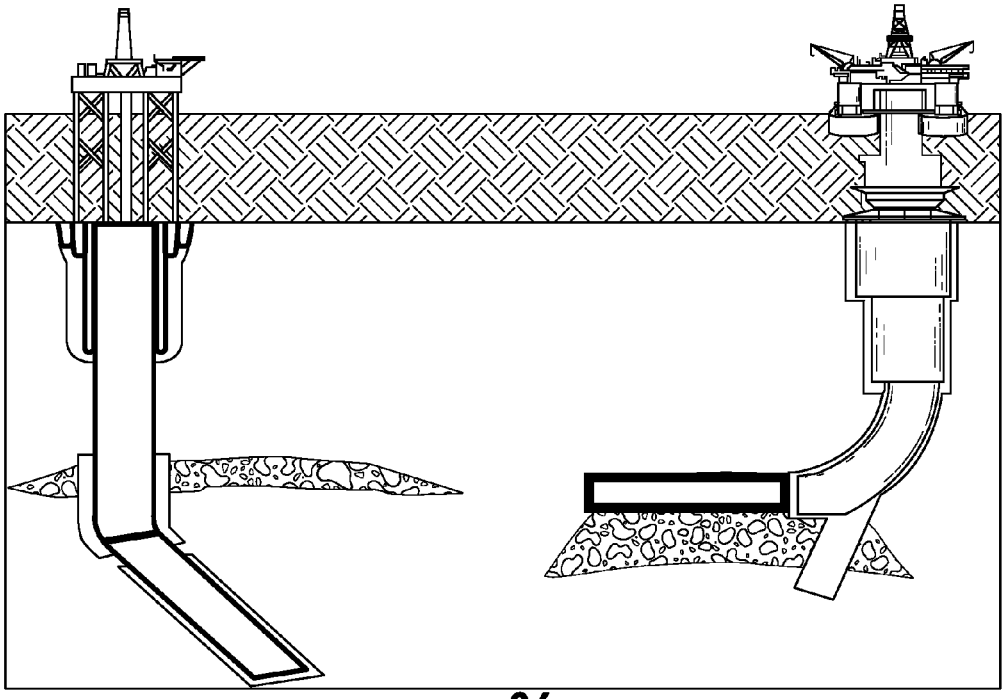
FIG. 6 shows, in schematic view, the start of drilling a horizontal well bore.

FIG. 6 shows the start of drilling a long-reach horizontal well bore (30) which starts from the pilot hole (20) in the direction of a fully equipped existing well (10), which becomes a target well of the drilling of the horizontal well bore and a future recipient of the production arising from this new deposit.

Figure 7:
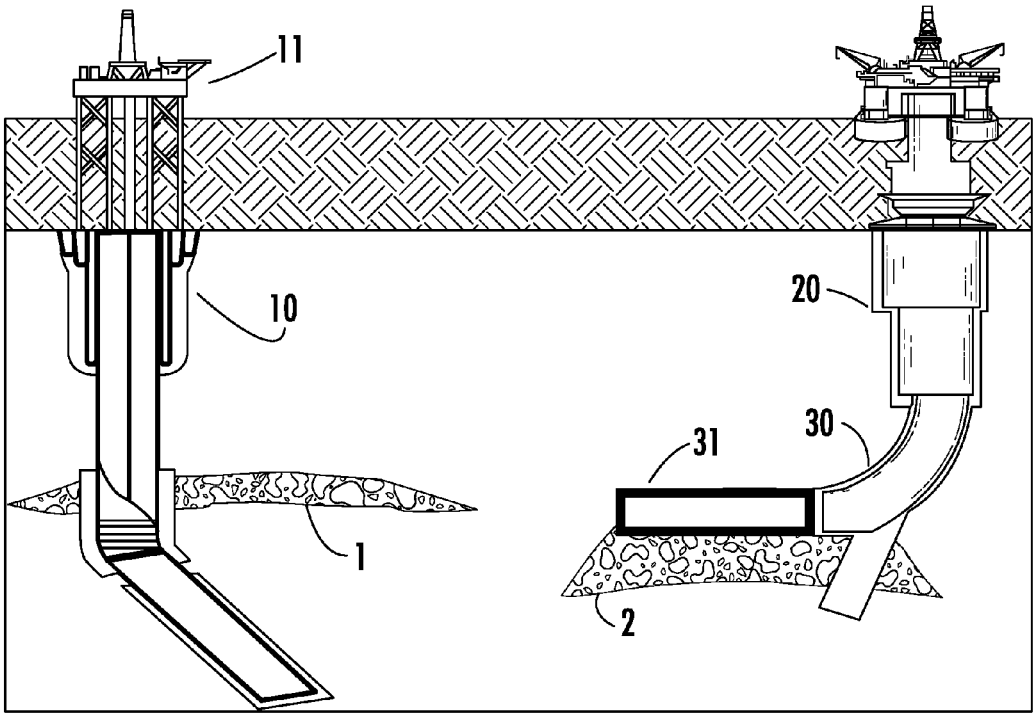
FIG. 7 shows, in schematic view, the casing of the production section.

This horizontal well bore (30) is preferentially drilled with a wide diameter (of the order of 3,300 to 3,500 mm) and passes through the reservoir (2) of low commercial value along its upper section. The following stage can be viewed by means of FIG. 7. When the drilling through all of the upper horizontal section (31) of the reservoir (2) has finished, the said upper horizontal section is duly cased so that it is possible to proceed with drilling the long section of shale.

Figure 8:
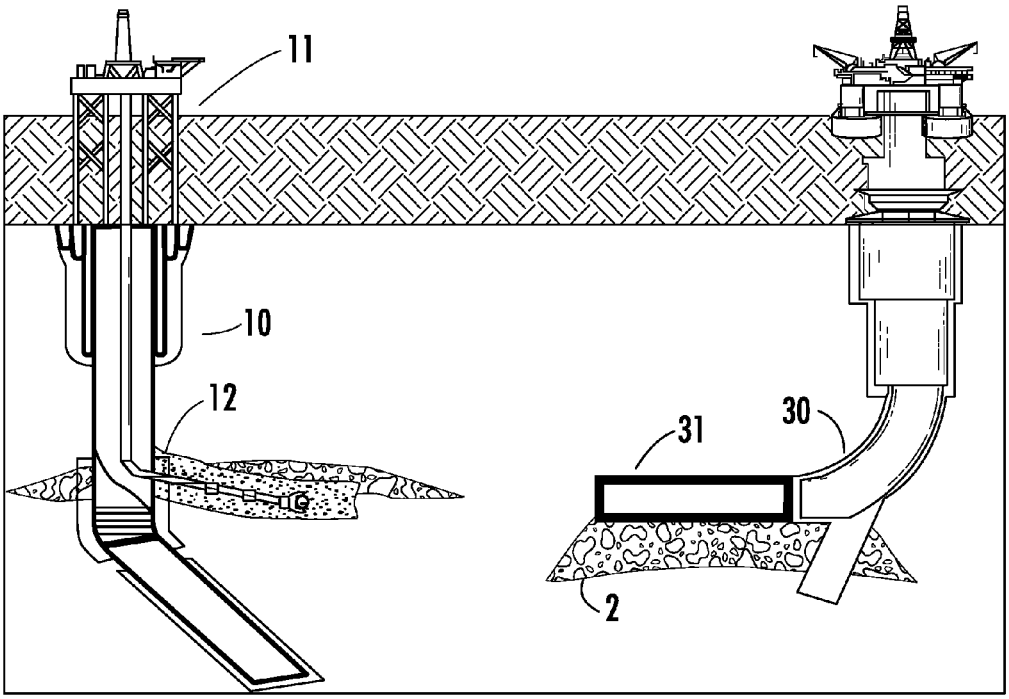
FIG. 8 shows, in schematic view, the formation of an opening in the target well.

Following confirmation of the economic and technical viability of the conventional pilot hole (20), according to the RLWB proposal of this invention, the preparatory procedures in the target well (10) can be started. The preparation of the above-mentioned existing well, which has become the target well (10), is started with its being provided with a deflecting channel (Whipstock or Packstock) and with an opening (12) being formed in its casing, as shown in FIG. 8.

Figure 9:
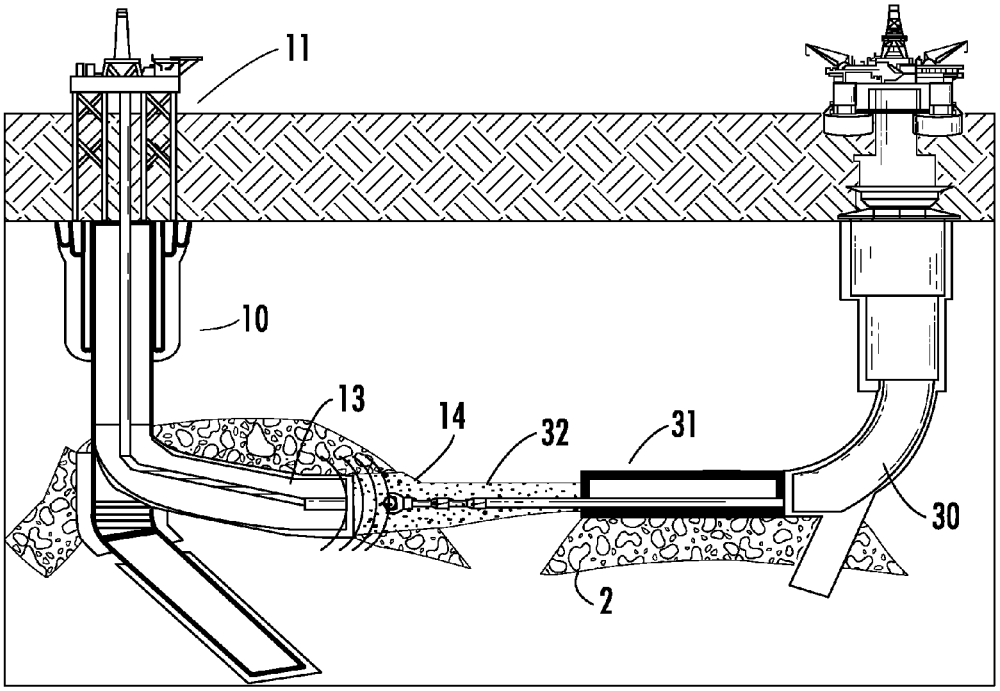
FIG. 9 shows, in schematic view, the opening-up of a receiving lateral leg in the target well with its respective casing and a portion of section without casing.

FIG. 9 schematically shows the drilling of a receiving lateral well bore (13), carried out from the opening (12). It will be possible to prepare the said opening in order for expandable casing to be provided on the receiving lateral well bore (13), depending on the project requirements.

In this section of cased well bore, at the end of the procedure, an electric pump set, which will lift the oil to the surface, can be installed. Downstream from the section of receiving lateral well bore (13), a small section of well bore (14) is left without casing, for the greatest possible length, preferentially between 300 m and 500 m in length. This section of well bore can be viewed in greater detail in FIG. 9.

In this small section of well bore (14) without casing, will be the point of interception between the two well bores—the receiving lateral well bore (13) and the horizontal well bore (30)—and it will remain without casing to ensure a safety margin at the time of interception as, if the above-mentioned interception does not take place precisely head on, it will still be possible for movement to take place laterally or in a diving direction but with a smooth transition.

After the receiving lateral well bore (13) has been cased, cemented and possibly expanded, the drilling of the long section (32) is continued through the shale coming from the upper horizontal section (31), up to the interception with the section of lateral well bore (14) without casing. The said long section (32) will be drilled with a diameter smaller than that of the upper lateral section (31), (for example, 2,000 to 2,200 mm). Once the desired interception between the well bores has been attained, the drilling stage is closed.

The prime advantages of this invention become clear, the said invention standing out not only due to its simplified configuration but principally due to its innovating implementation, the target and origin positions of the drilling being reversed on the commencement of the long-reach drilling from the region theoretically considered the target.

Figure 10:
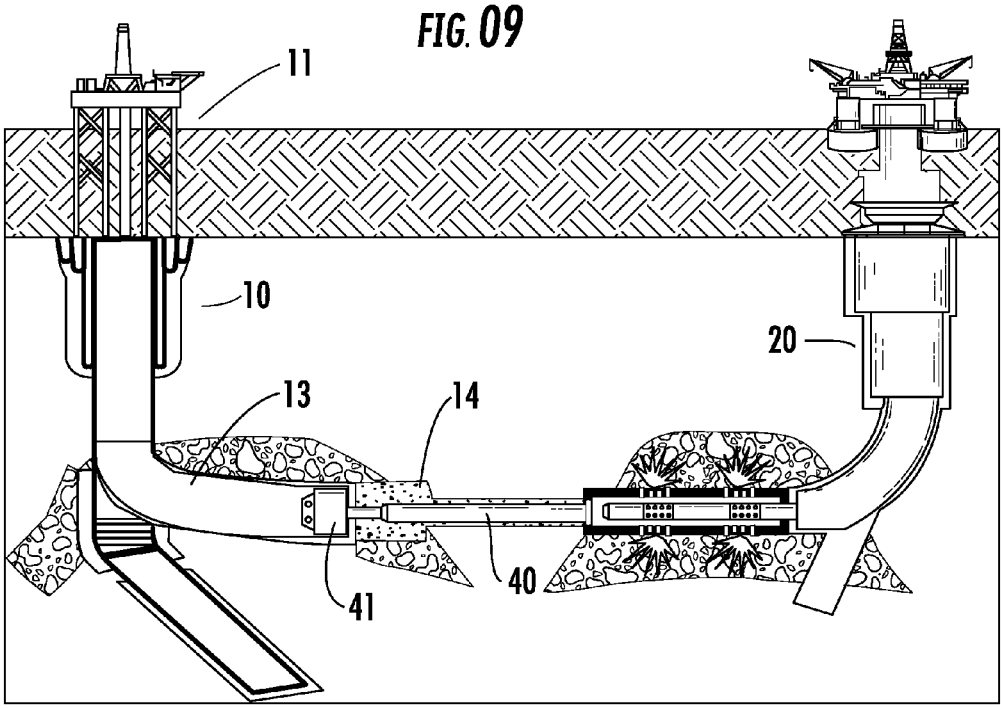
FIG. 10 shows, in schematic view, the fluidic intersection between the two wells.

FIG. 10 shows the initial stage of completion with the connection between the two wells—the existing well (10) and the pilot hole (20)—a casing pipe (40) being used, which runs from the new region of production (2) to the end of the receiving lateral well bore (13), where the intersection between the two sections of pipe is given an expandable seal (41), which is well known from technology.

Figure 11:
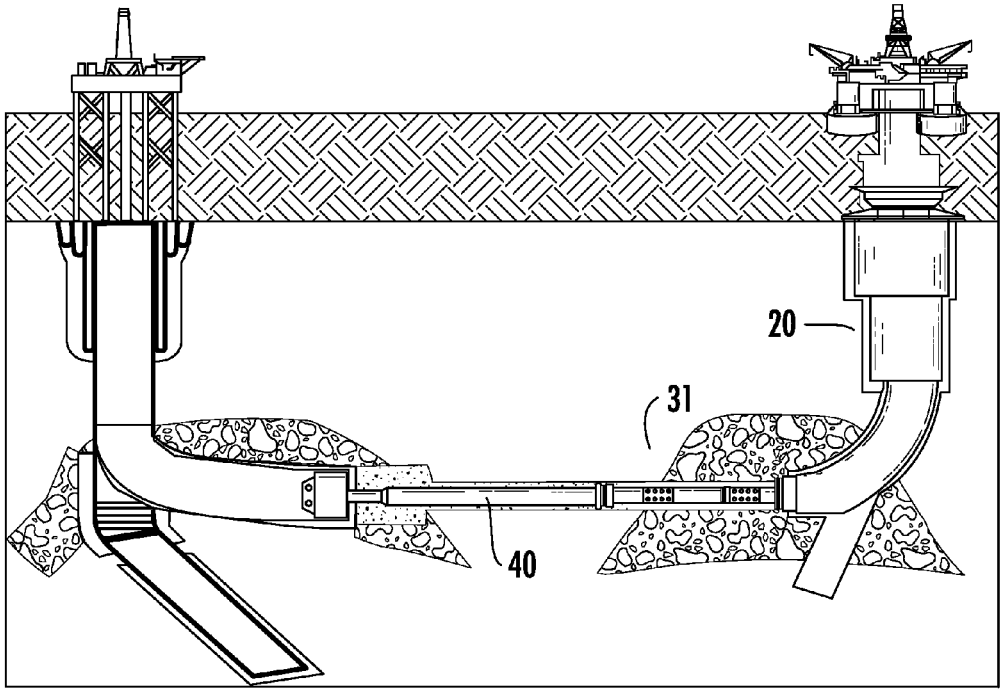
FIG. 11 shows, in schematic view, the completion procedure in the new production section.

FIG. 11 shows the stage at which the casing (40) is ready to be perforated in its productive section (31). The selective fracturing of the producing rock (selective Frac Pack) is then carried out. At the end of the completion, cement or mechanical plugs are fitted and the drill rig which carried out the procedure is released, the pilot hole (20) provisionally being abandoned.

Figure 12:
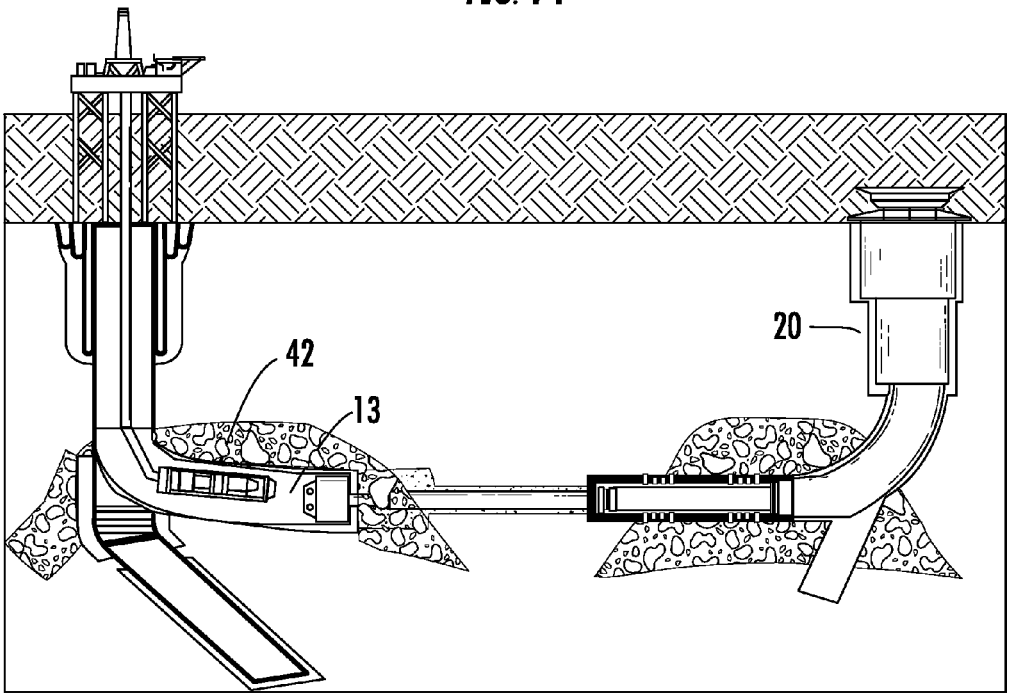
FIG. 12 shows, in schematic view, the proposed new configuration, now finished.

FIG. 12 shows the last stage of the implementation method and schematically illustrates the final appearance of the Receiving Lateral Well Bore—RLWB, this being the object of this invention, in which the wells are now interconnected fluidically and producing but only one of the wells being equipped with a Christmas tree.

At this stage, a SCP (Submerged Centrifugal Pumping) unit (42) is installed in the receiving lateral well bore (13) and the pilot hole (20) shall change over to producing also from the RLWB to the sole Christmas tree fitted.

An attractive aspect is that, whenever there is a need for work of great complexity in which an approach by means of the stationary production unit (11) does not allow it, there is the possibility of access through this pilot hole (20).

The advantage of this pioneering well conception is allowing and having available the most advantageous and well-known resources there are, both in the drilling procedure and in the well maintenance procedure:

1—being able to drill, using the technical resources, for example, of a large capacity semi-submersible drill rig for long well bores and causing the minimum impact on the stationary production unit (11) already in operation, which would not have technical and logistic resources for carrying out the procedure.

2—being able to carry out work which is fast, inexpensive and demands very few critical resources in the two production wells from the stationary production unit (11).

The method of implementing a receiving lateral well bore, this being the object of this invention, can be understood by means of the series of FIGS. 3 to 11 and in spite of not being limited specifically to the stages suggested here, capable of easily being deduced by a person skilled in the art, adjustments and technical variations but without departing from the concept described and explained.

Therefore, the method consists of the stages and procedures which are listed below but which, without going beyond the concept set out, can vary depending on the scenario and particular conditions encountered in each set of wells where it is wished to apply the above-mentioned method.

Some premises need to be considered.

1—Initial situation of a fully equipped existing well (10) which normally processes its production by means of a stationary production unit (11), also already installed, with dry or wet completion. Existence of a neighbouring field (2) at a great distance of 3 km or more; the neighbouring deposit (2) can already have a mature or de-activated well, in which exploitation has lost its commercial viability. For the purpose of starting the implementation of the present method, this reservoir (2) has already been bored, analysis has been carried out and the economic non-viability of the individual exploitation of same has been ascertained. The fitting of a dry Christmas tree (DCT) or wet Christmas tree (WCT) for exploiting the deposit/reservoir (2) would not be of low enough cost to make its economical exploitation viable.

2—Situation of non-existence of a well already drilled in the area of interest. The drilling of a conventional pilot hole (20) is started in the very area of the deposit/reservoir (2) of low commercial value. The conventional pilot hole (20) has the function of making it possible to map from the top to the base of the reservoir rock. This mapping will supply data for making the navigation of a long horizontal well bore possible.

3—After this procedure, the base of the said conventional pilot hole (20) is cemented (21) and abandoned.

4—A start is made on drilling a long-reach horizontal lateral well bore (30) in the direction of the fully equipped existing well (10), which becomes the target of the lateral drilling.

5—The above-mentioned lateral well bore (30) is preferentially drilled in a wide diameter and passes through the reservoir (2) of low commercial value preferentially along its upper section.

6—When the drilling through a complete upper horizontal section (31) of the reservoir (2) is finished, the said section (31) is duly cased in order that continuity can be given to the drilling of a long section of shale.

7—Subsequently, the economic and technical viability of the above-mentioned conventional pilot hole (20) having been confirmed, on the production basis proposed by the technology of this invention, the preparatory procedures can commence in the existing well (10), then converted to the target.

8—The preparation of the existing well which has become a target well (10) is started by its being provided with a deflecting channel (Whipstock or Packstock) and by an opening (12) being formed in its casing.

9—From the opening (12), the drilling of a receiving lateral well bore (13) is started.

If it is a project requirement, the said opening (12) will possibly have to be prepared to allow expandable casing to be subsequently provided on the receiving lateral well bore (13).

10—The receiving lateral well bore (13) is duly cased, leaving at its end a small section of well bore (14) without casing, preferentially between 300 m and 500 m.

In this small section of well bore (14) without casing, will be the point of interception between the well bores and it will remain without casing to ensure a safety margin at the time of interception as, if it does not take place precisely head on, it will be possible for movement to take place laterally or in a diving direction but with a smooth transition.

11—After the receiving lateral well bore (13) has been cased, cemented and—if necessary—expanded, the drilling of a long section (32) is proceeded with through the shale from the upper horizontal section (31), until the interception with the section of lateral well bore (14) without casing is attained.

The desired interception between the well bores having been obtained, the drilling stage is closed.

12—The completion starts with the connection between the existing well (10) and the pilot hole (20), a casing pipe (40) being used, provided from the new region of production (2) to the end of the receiving lateral well bore (13).

13—The intersection between the two sections of pipe is given an expandable seal (41), which is known from technology.

14—The casing pipe (40) is perforated in its productive section (31).

15—The selective fracturing of the producing rock (selective Frac Pack) is carried out.

16—At the end of the completion, the provisional abandonment of the pilot hole (20) is carried out, with cement or mechanical plugs, the drill rig which carried out the procedure being released.

17—Equipment for pumping is installed in the receiving lateral well bore (13) and the pilot hole (20) will change over to flowing from the reservoir rock to the RLWB.

For a person skilled in the art, it is understood that equivalent methods can be used, depending on the scenario found. Having as a starting point an initial situation in which a fully equipped well (10), which normally processes its production, with dry or wet completion, neighbours on another mature or de-activated well (20), where it is ascertained that it is economically unviable for its exploitation by means of a wet Christmas tree—WCT and the installation of a SPU for dry completion would not be economically justified either, then in this case, for example, the procedures for implementing the RLWB can start from stage 6 of the method already disclosed.

One of the principal factors which makes this proposal viable is the oil industry's mastery of all the technical stages necessary for the perfect implanting of the project: the technologies of well interceptions, of forming openings in existing wells, drilling long well bores and the directing of well drilling by means of magnetic orientation among others.

One of the unquestionable advantages of the proposed invention is, therefore, minimising the abandonment of wells or deposits considered unviable for reasons of cost in implementation and of production equipment.

The invention has been described here with reference to its preferred embodiments. It must, nevertheless, be clear that the invention is not limited to these embodiments and persons skilled in the art will immediately understand that alterations and replacements can be adopted without abandoning the inventive concept described herein.

The invention claimed is:

1. A wellbore system, comprising:

a first wellbore (10) comprising a cased section and an opening (12) in said cased section, wherein said first wellbore (10) intersects a first deposit reservoir (1) in a first field, and said first wellbore (10) is equipped for active production and processing of the first deposit reservoir (1);

a pilot hole (20) in a second field that is a distance away from said first field, wherein said second field comprises a second deposit reservoir (2);

a horizontal lateral wellbore (30) connected to said pilot hole (20), wherein said lateral wellbore (30) comprises a section (31) that intersects said second deposit reservoir (2);

a receiving lateral wellbore (13) extending through said opening (12) in said cased section of said first wellbore (10) in a direction towards said lateral wellbore (30), wherein said receiving lateral wellbore (13) comprises a cased portion and an uncased portion (14), and said uncased portion (14) is downstream of said cased portion;

a lateral wellbore section (32) extending from said section (31) of said lateral wellbore (30) in the direction of said first wellbore (10) and intercepting said uncased portion (14) of said receiving lateral wellbore (13);

said lateral wellbore section (32) having a smaller diameter than that of said section (31) of said lateral wellbore (30);

a pipe (40) is provided from said second deposit reservoir (2) to an end of said receiving lateral wellbore (13), wherein an intersection between said pipe (40) and said receiving lateral wellbore (13) comprises an expandable seal (41), and said pipe (40) is perforated in said section intersecting said second deposit reservoir (2); and said first wellbore (10) and said pilot hole (20) are interconnected fluidically but only said first wellbore (10) is equipped with a Christmas tree.

2. The wellbore system according to claim 1, wherein said first wellbore (10) is configured to receive production arising from the second deposit reservoir (2).

3. The wellbore system according to claim 1, wherein said pilot hole (20) is configured to make it possible to map said second deposit reservoir (2).

4. The wellbore system according to claim 1, wherein said lateral well bore (30) comprises a diameter in a range from 3,300 to 3,500 mm in a section passing through said second deposit reservoir (2) and said lateral wellbore section (32) comprises a diameter in a range from 2,000 to 2,200 mm.

5. The wellbore system according to claim 1, wherein said cased portion of the receiving lateral wellbore (13) comprises an expandable casing.

6. The wellbore system according to claim 1, wherein a pumping system configured to lift oil is installed in said receiving lateral well bore (13).

7. The wellbore system according to claim 1, wherein said receiving lateral well bore (13) is provided with a pumping system directed to said first wellbore (10).

8. A method for implementing a wellbore system, comprising:

equipping a first wellbore (10) for production from a first deposit reservoir (1) in a first field, mapping a top to a base of a reservoir rock from within a pilot hole (20) to ascertain information regarding a second deposit reservoir (2) in a second field, cementing (21) a base of said pilot hole (20) and abandoning said pilot hole (20) after the mapping, drilling a horizontal lateral well bore (30) in a direction of said first wellbore (10) from said pilot hole (2), wherein said lateral well bore (30) passes through said second deposit reservoir (2), casing a section (31) of said lateral wellbore (30) within said deposit reservoir (2) when the drilling of the said section (31) is finished, providing said wellbore (10) with a deflecting channel and forming an opening (12) in its casing, drilling a receiving lateral wellbore (13) from said opening (12), casing said receiving lateral wellbore (13) with an expandable casing and leaving an end of said receiving lateral wellbore (13) with an uncased section (14), drilling a lateral wellbore section (32) from said section (31) of said lateral wellbore (30), until intercepting the uncased section (14) of said receiving lateral wellbore (13), connecting said first wellbore (10) and said pilot hole (20) by providing a pipe (40) from a location within said second deposit reservoir (2) to an end of said receiving lateral well bore (13), installing an expandable seal (41) at an intersection of the ends of said receiving lateral well bore (13) and said lateral wellbore section (32), perforating said pipe (40) in a location that intersects said second deposit reservoir (2) and carrying out selective fracturing of a producing rock in said second deposit reservoir (2), and abandoning said pilot hole (20) by fitting plugs and releasing a drill rig that carried out the drilling procedures.

9. The method for implementing a receiving lateral well bore, according to claim 8, wherein a pumping system is installed in said receiving lateral well bore (13).

10. A method for implementing a wellbore system, comprising:

equipping a first wellbore to draw from a first deposit reservoir (1) in a first field, said first wellbore neighboring a mature or de-activated well (20) in a second field, drilling a horizontal lateral wellbore (30) in a direction of said first wellbore (10), wherein said horizontal lateral well bore (30) passes through a second deposit reservoir (2) in said second field, casing an upper horizontal section (31) of said horizontal lateral wellbore (30) intersecting said second deposit reservoir (2) when the drilling of said horizontal lateral wellbore (30) is finished, providing said first wellbore (10) with a deflecting channel and forming an opening (12) in a casing of said first wellbore (10), drilling a receiving lateral wellbore (13) from said opening (12), casing said receiving lateral wellbore (13) with an expandable casing, leaving an uncased section (14) of said receiving lateral wellbore (13), drilling a lateral wellbore section (32) from said upper horizontal section (31) of said horizontal lateral wellbore (30), until intercepting with said uncased section (14) of said receiving lateral wellbore (13), connecting said first wellbore (10) and said mature or deactivated well (20) by providing a casing pipe (40) from a region of production of said deposit reservoir (2) to an end of said receiving lateral well bore (13), installing an expandable seal (41) at an intersection of the ends of said receiving lateral well bore (13) and said lateral wellbore section (32), and perforating said pipe (40) in a productive section of said second deposit reservoir (2) and fracturing a producing rock in the said second deposit reservoir (2).

* * * * *